US008983338B2

(12) United States Patent
Numazu et al.

(10) Patent No.: US 8,983,338 B2
(45) Date of Patent: Mar. 17, 2015

(54) IMAGE FORMING APPARATUS

(71) Applicants: Casio Electronics Manufacturing Co., Ltd., Saitama (JP); Casio Computer Co., Ltd., Tokyo (JP)

(72) Inventors: Toshihiko Numazu, Sayama (JP); Kazuhiro Kameyama, Tokyo (JP); Yusuke Tokuda, Hino (JP); Toshihiro Ogawa, Fussa (JP); Ryoji Abe, Fussa (JP)

(73) Assignees: Casio Electronics Manufacturing Co., Ltd., Iruma-shi, Saitama-Ken (JP); Casio Computer Co., Ltd., Tokyo (JP)

( * ) Notice: Subject to any disclaimer, the term of this patent is extended or adjusted under 35 U.S.C. 154(b) by 190 days.

(21) Appl. No.: 13/705,451

(22) Filed: Dec. 5, 2012

(65) Prior Publication Data

US 2013/0142526 A1 Jun. 6, 2013

(30) Foreign Application Priority Data

Dec. 6, 2011 (JP) ..... 2011-267245
Jul. 4, 2012 (JP) ..... 2012-150240

(51) Int. Cl.
*G03G 15/20* (2006.01)
*G03G 21/16* (2006.01)

(52) U.S. Cl.
CPC ..... *G03G 15/2039* (2013.01); *G03G 21/1685* (2013.01)
USPC ..... 399/122

(58) Field of Classification Search
CPC ..... G03G 15/20
USPC ..... 399/122
See application file for complete search history.

(56) References Cited

U.S. PATENT DOCUMENTS 7,856,187 B2 12/2010 Dan
2004/0052548 A1* 3/2004 Shimizu et al. ..... 399/122

(Continued)

FOREIGN PATENT DOCUMENTS

JP 63149683 A * 6/1988 ..... G03G 15/20
JP 01109390 A * 4/1989 ..... G03G 15/20
JP 6-274054 A 9/1994

(Continued)

OTHER PUBLICATIONS

Japanese Office Action dated Dec. 4, 2012 (and English translation thereof) in counterpart Japanese Application No. 2012-150240.

*Primary Examiner* — Nguyen Ha
(74) *Attorney, Agent, or Firm* — Holtz, Holtz, Goodman & Chick PC

(57) ABSTRACT

In an image forming apparatus provided with a detachable fixing unit having fixing paired-rollers, a heating unit heats at least one of the fixing paired-rollers, and a temperature detecting unit detects a temperature of the detachable fixing unit. The image forming apparatus is further provided with an adjustment mechanism for preventing the detachable fixing unit from being taken out from the apparatus body, when the temperature detecting unit determines that the temperature of the detachable fixing unit exceeds a predetermined value, and allowing the detachable fixing unit to be taken out from the apparatus body, when the temperature detecting unit determines that the temperature of the detachable fixing unit is the predetermined value or less, whereby protecting users from getting their hands burned when taking out the detachable fixing unit from the apparatus body.

10 Claims, 12 Drawing Sheets

(56) References Cited

U.S. PATENT DOCUMENTS

| | | | | |
|---|---|---|---|---|
| 2006/0140675 | A1* | 6/2006 | Kim et al. | 399/122 |
| 2006/0257183 | A1* | 11/2006 | Ehara et al. | 399/405 |
| 2009/0041481 | A1* | 2/2009 | Iida et al. | 399/12 |
| 2009/0245826 | A1* | 10/2009 | Dan | 399/44 |
| 2009/0310997 | A1* | 12/2009 | Lee et al. | 399/70 |
| 2011/0236084 | A1* | 9/2011 | Nishida et al. | 399/328 |

FOREIGN PATENT DOCUMENTS

| | | | |
|---|---|---|---|
| JP | 2005-258264 | A | 9/2005 |
| JP | 2009-244504 | A | 10/2009 |

* cited by examiner

IMAGE FORMING APPARATUS

CROSS-REFERENCE TO RELATED APPLICATION

The present application is based upon and claims the benefit of priority from the prior Japanese Patent Application No. 2011-267245, filed Dec. 6, 2011, and Japanese Patent Application No. 2012-150240, filed Jul. 4, 2012, the entire contents of which are incorporated herein by reference.

BACKGROUND OF THE INVENTION

1. Field of the Invention

The present invention relates to an image forming apparatus, and more particularly, to an image forming apparatus, which is provided with a mechanism for preventing trouble from happening, in which the users get their hands burned by a hot heat fixing unit, while taking out the heat fixing unit from the apparatus for maintenance purpose.

2. Description of the Related Art

Image forming apparatuses are widely used, which employ an electro-photographic toner system to form a toner image on an image-supporting member, and transfer the toner image onto a paper, and then fix the transferred toner image on the paper using a fixing unit.

These image forming apparatuses are provided with plural detachable internal units such as a belt unit, an image forming unit, and an image fixing unit. In the maintenance operation of these units, users take out the internal units from the apparatus body to repair or replace them.

For example, during the printing operation of the image forming apparatus, the temperature of image fixing unit is kept at around 110 to 180 degrees Centigrade. When a jammed paper happens in the image fixing unit and the user tries to take out the image fixing unit from the apparatus body to remove the jammed paper, the user's carelessness can invite an accident of getting burned.

To prevent the above accident from happening when the user takes out the image fixing unit from the apparatus body, an image fixing unit of a printer is proposed by Japanese Unexamined Patent Publication Hei 06-274054, in which a character string of "CAUTION HOT" is printed on the peripheries of a pressure roller and a heat roller consisting the image fixing unit to draw the user's attention.

In general, the jammed papers in the image fixing unit are roughly classified into two groups: one group including the jammed papers wrapping around either of the pressure roller and heat fixing roller, with a portion of the rear edge of the paper left outside the fixing unit, and other group including the jammed papers completely wrapping around either of the pressure roller and heat fixing roller with no portion left outside the fixing unit and the jammed papers fold up into concertinas and staying within the fixing unit.

In the case of the jammed papers wrapping around the roller with the rear edge of the paper left outside the fixing unit, in many cases, the user can remove the jammed paper from the fixing unit by pulling out the rear edge of the paper. But in the case of the jammed papers completely wrapping around the roller with no portion left outside the fixing unit and the jammed papers fold up into concertinas and staying within the fixing unit, it is impossible to remove the jammed paper from the fixing unit with the fixing unit installed within the apparatus.

In the case of the jammed papers, the whole size of which completely stays within the fixing unit, the user is required to take out the fixing unit from the image forming apparatus and to open a protection cover with careful attention not to get burned to remove the jammed paper from the fixing unit.

As disclosed in Japanese Unexamined Patent Publication Hei 06-274054, the character string of "CAUTION HOT" is printed on the peripheries of the pressure roller and the heat roller, but these rollers are disposed within a housing of the image fixing unit. Therefore, even though the user takes out the image fixing unit from the printer body, there will be no chance for the user to read the caution of "CAUTION HOT", when the protection cover is not open.

Further, in the case of the paper completely wrapping around with no edge left outside the fixing unit, even if the protection cover is opened, the caution of "CAUTION HOT" is covered with the wrapping paper, which will prevent the user from reading the caution of "CAUTION HOT". In this case, the character string of "CAUTION HOT" printed on the rockers will be of no effect to draw the user's attention, when the hot fixing unit is taken out of the printer body From the viewpoint of safety first, that is, protecting the users from getting burned, the fixing unit proposed by Japanese Unexamined Patent Publication Hei06-274054 is not a device safe enough, and a problem is still left that further measures for safety are required.

SUMMARY OF THE INVENTION

The present invention is to solve the conventional problem mentioned above, and provides an image forming apparatus that is provided with a mechanism, which protects the users from getting burned when they take out the fixing unit from the apparatus body for maintenance.

According to one aspect of the present invention, there is provided an image forming apparatus, which comprises an apparatus body having a frame, a detachable fixing unit having fixing paired-rollers, and installed in the apparatus body, a heating/controlling unit for heating and controlling at least one roller of the fixing paired-rollers of the detachable fixing unit, a driving source unit for driving the one roller of the fixing paired-rollers heated by the heating/controlling unit, a temperature detecting unit for detecting a temperature of the detachable fixing unit, and an adjustment mechanism for preventing the detachable fixing unit from being taken out from the apparatus body, when the temperature detecting unit determines that the temperature of the detachable fixing unit exceeds a predetermined value, and for allowing the detachable fixing unit to be taken out from the apparatus body, when the temperature detecting unit determines that the temperature of the detachable fixing unit does not exceed the predetermined value.

As described above, the present invention provides the image forming apparatus provided with the mechanism, which protects the users from getting burned when they take out the fixing unit from the apparatus body for a maintenance purpose.

BRIEF DESCRIPTION OF THE DRAWINGS

A more complete understanding of the present invention will be obtained when the following detailed description is considered in conjunction with the following drawings, in which.

DETAILED DESCRIPTION OF THE PREFERRED EMBODIMENTS

Now, preferred embodiments of the present invention will be described with reference to the accompanying drawings.

Embodiment 1

Figure 1:
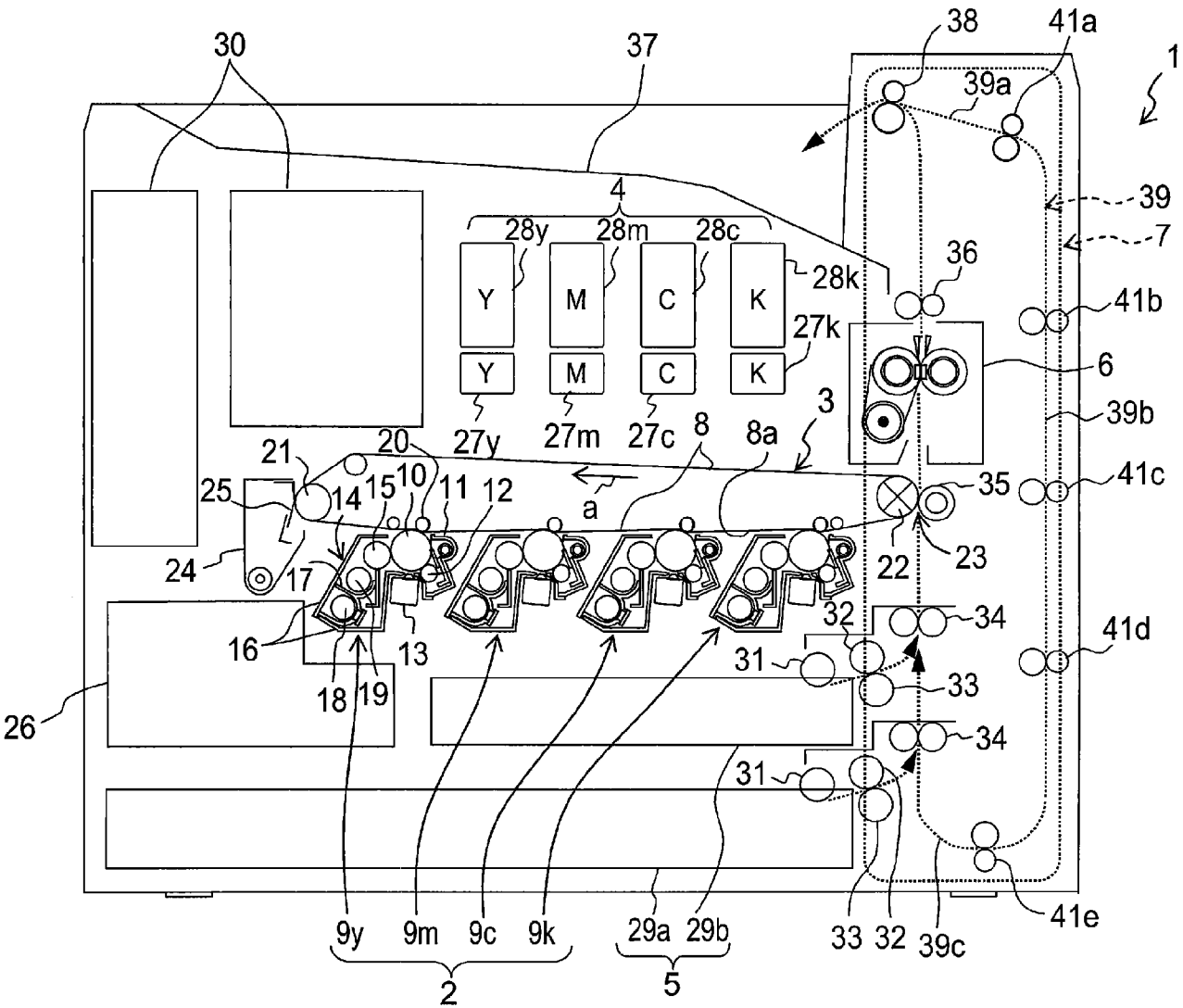
FIG. 1 is a cross-sectional view showing an internal construction of a full color image-forming apparatus (printer) according to embodiments of the present invention.

FIG. 1 is a cross-sectional view showing an internal construction of a full color image-forming apparatus (hereinafter, referred to as a "printer" or "present apparatus") according to the embodiment 1 of the present invention.

The full color image-forming apparatus 1 has a tandem configuration, as shown in FIG. 1 and is a printer of a secondary electro-photographic transfer system. The printer 1 comprises an image forming unit 2, a transfer belt unit 3, a toner feeding unit 4, a paper feeding unit 5, a belt-type heat fixing unit 6 (hereinafter, referred to as a "fixing unit"), and a double-sided printing conveyance unit 7.

The image forming unit 2 is a multistage developing device 9, which consists of four developing devices 9 (9*k*, 9*c*, 9*m*, and 9*y*). These developing devices 9 (9*k*, 9*c*, 9*m*, and 9*y*) align right to left, as seen in FIG. 1, so as to contact with an under running surface 8*a* of the transfer belt 8 of the transfer belt unit 3. The image forming unit 2 is held to a frame of the printer body 1 so as to move from a position (printing position) for a printing operation shown in FIG. 1 downward to a position for maintenance.

Three developing devices 9*c*, 9*m*, and 9*y* arranged upstream (left side in FIG. 1) among the four devices 9 are provided for forming three mono-color images, that is, images of subtractive primary three colors, Cyan (C) toner, Magenta (M) toner, and Yellow (Y) toner, respectively. The developing device 9*k* is provided for forming a monochrome image of black (K) toner, used for characters and dark parts in an image.

All the developing devices 9 (9*k*, 9*c*, 9*m*, and 9*y*) have the same structure except the toner used therein. Using the example of the developing device 9*y* for the yellow (Y) toner, the structures of these developing devices will be described hereinafter.

The developing device 9 is provided with a photoreceptor drum 10 at its top. The photoreceptor drum 10 has an outer periphery, which is made of an organic photoconductive member. There are arranged a cleaner 11, a charge roller 12, an optical writing head 13, a developer 14, and a developing roller 15 around the periphery of the photoreceptor drum 10.

Further, the developer 14 is provided with an external housing 16, an internal partition wall 17, the developing roller 15, a first mixing/feeding screw 18, and a second mixing/feeding screw 19. The first and second mixing/feeding screws 18, 19 each have a screw shaft and a rotary fin integrally fixed to the shaft (these are not shown).

Either of the toners, Black (K), Cyan (C), Magenta (M), and Yellow (Y) indicated by K, C, M, and Y in FIG. 1 is fed to the developer 14 from reserve tanks 27 (27*k*, 27*c*, 27*m*, and 27*y*) of the toner feeding unit 4.

The transfer belt unit 3 is provided with an endless transfer belt 8, a driving roller 21 and a driven roller 22. The endless transfer belt 8 is extended between the driving roller 21 and the driven roller 22 substantially in the horizontal direction as viewed in FIG. 1 and is driven in the counter clockwise direction, as indicated by an arrow "a" in FIG. 1.

The transfer belt 8 has a primary transfer roller 20, which is integrally provided together with the unit. The primary transfer roller 20 is resiliently pressed onto the photoreceptor drum 10 through the transfer belt 8 to transfer a toner image onto the surface of the transfer belt 8 (primary transfer). Further, the transfer belt 8 carries the toner image to a secondary transferring unit 23 to transfer the toner image onto a paper (secondary transfer).

A belt cleaner 24 is set to the transfer belt 8. The belt cleaner 24 has a cleaning blade 25, which contacts the surface of the transfer belt 8 driven by the driving roller 21. A detachable waste-toner recovery container 26 is mounted beneath the belt cleaner 24.

Using the cleaning blade 25, the belt cleaner 24 serves to rub out the waste toner staying on the surface of the transfer belt 8, and sends the rubbed out toner into the waste-toner recovery container 26 with its feeding screw.

The toner feeding unit 4 consists of four reserve tanks 27 (27*k*, 27*c*, 27*m*, and 27*y*) and four detachable toner cartridges 28 (28*k*, 28*c*, 28*m*, and 28*y*) for supplement toner. The reserve tanks 27*k*, 27*c*, 27*m*, and 27*y* are disposed on the upper side of the upper running portion of the transfer belt 8, and further the detachable toner cartridges 28*k*, 28*c*, 28*m*, and 28*y* are disposed respectively on the reserve tanks 27 (27*k*, 27*c*, 27*m*, and 27*y*).

The detachable toner cartridges 28*k*, 28*c*, 28*m*, and 28*y* contain the toners, Black (K), Cyan (C), Magenta (M), and Yellow (Y), respectively, and the reserve tanks 27 (27*k*, 27*c*, 27*m*, and 27*y*) are refilled with the toners from the toner cartridges 28*k*, 28*c*, 28*m*, and 28*y*, respectively.

The four reserve tanks 27 are connected respectively to the developers 14 of the developing device 9 through toner feeding paths (not shown).

The toner feeding unit 4 is held to the frame of the printer body 1 so as to move from the printing position shown in FIG. 1 upward to a position for maintenance.

On the left side of the toner feeding unit 4, two electric units 30, 30 are disposed around the belt cleaner 24 and the driving roller 21. The electric unit 30 involves circuit boards with an electronic controlling unit consisting of plural electronic parts.

The paper feeding unit 5 consists of two paper feeding cassettes 29 (29*a*, 29*b*), one being piled on top of another, as shown in FIG. 1. In the vicinity of the paper feeding openings (right side) of the two paper feeding cassettes 29*a*, 29*b*, there are provided paper take-up rollers 31, 31, paper-sending rollers 32, 32, paper-handling rollers 33, 33, and stand-by conveying paired-rollers 34, 34.

In the paper conveying direction (in the vertical direction as viewed in FIG. 1), in which a paper is conveyed by the stand-by conveying paired-rollers 34, there is provided a secondary transfer roller 35, which is resiliently pressed against the driven roller 22 with the transfer belt 8 held between them. The transfer belt 8, driven roller 22 and the secondary transfer roller 35 operate together to function as the secondary transferring unit 23 for transferring a toner image onto the paper.

The fixing unit 6 is disposed downstream (upper side of FIG. 1) of the secondary transferring unit 23. Further downstream of the fixing unit are arranged discharging paired-rollers 36 for taking up the paper from the fixing section 15 and paper ejecting paired-rollers 38 for ejecting the paper onto a paper ejecting tray 37 formed on the top surface of the printing apparatus 1.

The double-sided printing conveyance unit 7 has an outer surface (a right side cover as viewed in FIG. 1), which serves as an access member of the printing apparatus 1.

The double-side printing conveyance unit 13 provides a return path including a starting return path 39*a*, an intermediate return path 39*b*, and a terminal return path 39*c*. The starting return path 39*a* diverges from the paper ejecting paired-rollers 38 to the right (as viewed in FIG. 1), and the intermediate return path 39*b* follows the starting return path 39*a* and runs downward to the terminal return path 39*c*, and the terminal return path 39*c* turns to the left (as viewed in FIG. 1) to finally make the paper turn over.

In mid-course of the return path 39, there are provided five sets of return paired-rollers 41 (41*a*, 41*b*, 41*c*, 41*d* and 41*e*). An outlet of the terminal return path 39*c* leads to a paper-conveying path to the stand-by conveying paired-rollers 34 corresponding to the lower paper feeding cassette 29*b* of the paper feeding unit 5.

Figure 2:
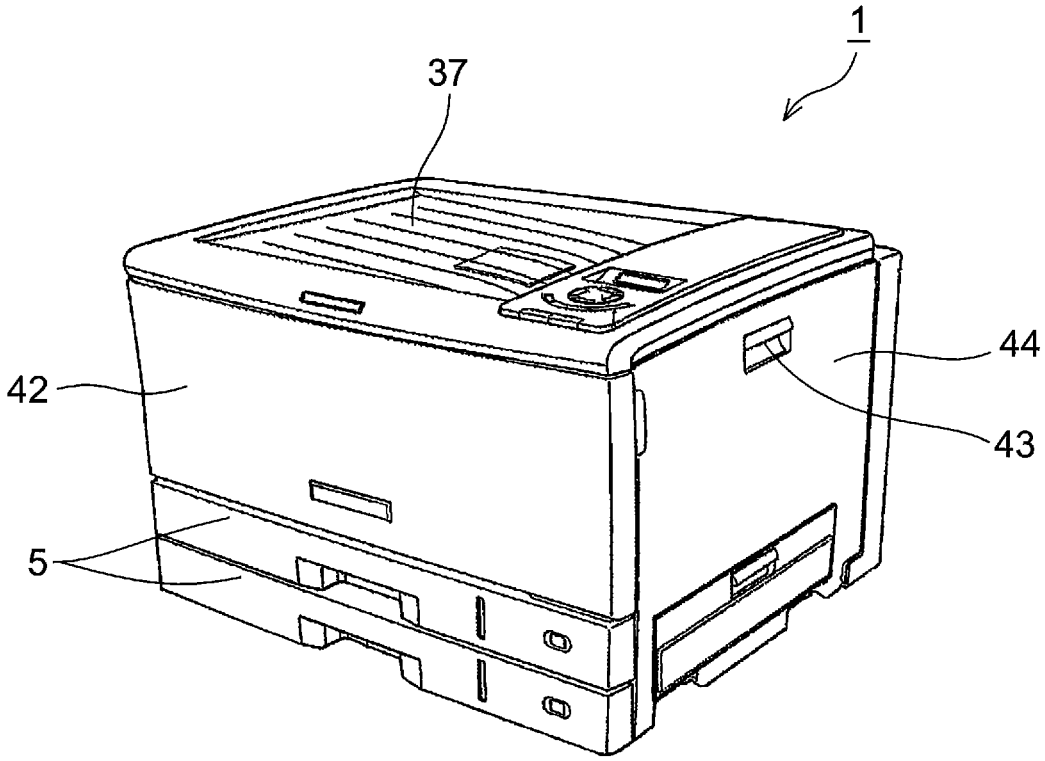
FIG. 2 is a perspective view showing an appearance of the printer according to the embodiments of the present invention.

FIG. 2 is a perspective view showing an appearance of the printer 1. In FIG. 2, like component parts as those in FIG. 1 are designated by like reference numerals.

As shown in FIG. 2, the printer 1 is provided with a front door (an opening-and-closing door) 42 in its front, and an access member 44 with a hold 43 on its right side. The double-sided printing conveyance unit 7 shown in FIG. 1 is integrated with the access member 44.

The printer 1 does not employ a system, which transfers the toner image directly onto the paper, but a system, which transfers the toner image by means of the transfer belt 8 to the paper, which is conveyed in the vertical direction to the secondary transferring unit by the stand-by conveying paired-rollers 34.

Therefore, since troubles such as paper jams do not arise in a kit-disposed portion, the printer 1 is constructed to allow a user to replace consumables such as kits concentrating to the left side in FIG. 1 with the front door 42 open. With the front door 42 (shown in FIG. 2) open, the user can replace the kits by pulling them towards the front door 42.

The printer 1 employs the system, which transfers the toner image through the transfer belt 8 onto the paper, which is conveyed in the vertical direction to the secondary transferring unit, and further conveys the paper in the vertical direction to fix the transferred toner image on the paper.

Figure 3A:
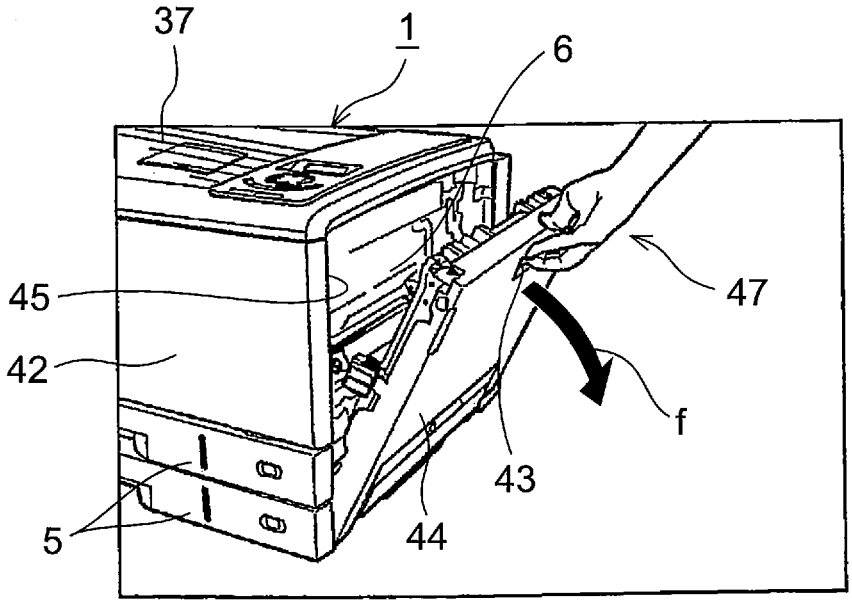
FIG. 3A is a view showing the printer with an access member half-open.

Therefore, in the case where a maintenance work is performed to recover the troubles such paper jams arising along the paper conveyance path, it is simply required to keep the access member 44 open, as shown in FIG. 3A.

But, even in the case where the paper jam arises along the paper conveyance path, when such paper jam arises within the fixing unit 6 and/or the whole jammed paper is involved within the fixing unit 6, in order to solve the trouble of the jammed paper, the fixing unit 6 is required to be pulled out from the printer body 1 with the access member 44 and the front door 42 open.

Figure 3B:
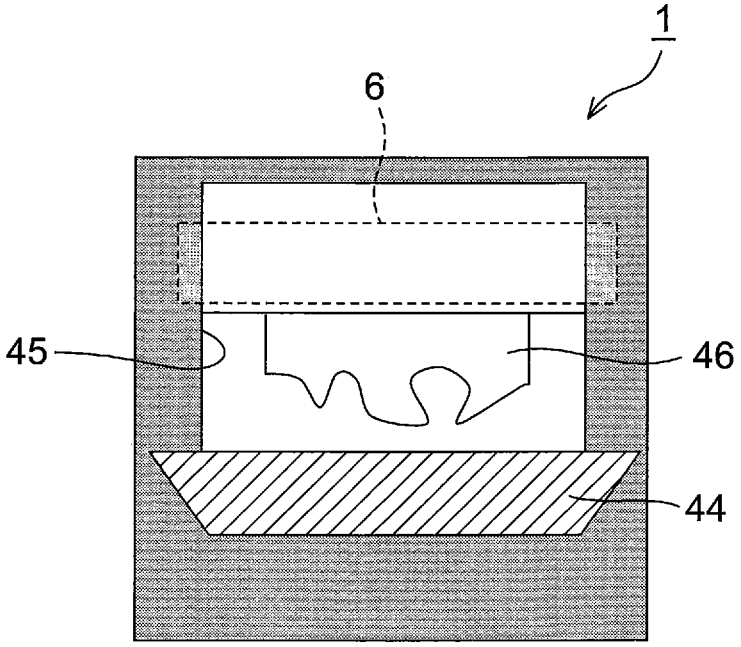
FIG. 3B is a view schematically showing an inside of the printer body with the access member open.

FIG. 3A is a view showing the printer 1 with the access member 44 half-open. At the time when the maintenance is performed when the paper jam arises within the fixing unit 6, the access member on the right side of the printer body 1 is open as shown in FIG. 3A. FIG. 3B is a view schematically showing the inside of the printer body 1 with the access member 44 open.

As shown in FIG. 3A, when the access member 44 of the printer 1 is open in the direction indicated by an arrow "f", the inside of the printer body 1 can be seen from an opening 45. In the inside of the printer body 1, the belt-type heat fixing unit 6 is seen at the upper side and a rear edge of a jammed paper 46 coming down from the fixing unit 6 can be seen as shown in FIG. 3B.

In this case, the user can remove the jammed paper 46 by pulling down the rear edge of the jammed paper 46. In the present embodiment, as will be described later in detail, since a resilient pressure applied to Nip portion of the fixing paired-rollers is automatically released when the fixing unit 6 is unlocked from its operating position, and therefore, the jammed paper 46 can be easily removed downwards.

It is also possible to provide a lever on a driving roller of the fixing paired-rollers to rotate the driving roller in the forward direction, and the user uses the lever to rotate the fixing paired-rollers, thereby making the jammed paper 46 pass through of Nip portion of the fixing paired-rollers and removing the jammed paper 46 upwards.

As described above, generally in many cases, it is possible to remove the jammed paper 46 involved in the fixing unit 6 from the printer body 1 with the fixing unit 6 mounted within the printer body 1 without taking out the fixing unit 6 from the printer body 1.

Some states of the jammed paper can make it hard to remove the jammed paper 46 as in the above mentioned manners. For instance, in the case where an extremely thin paper is used, the thin paper wraps around one of the fixing paired-rollers, and the whole paper can stay within the fixing unit 6.

Further, in the case where a high density image is printed to the edge of the paper, the toner melting to the glass-transition point in the fixing unit 6 sticks onto the heat roller, preventing the paper from separating from the heat roller and causing the jammed paper.

Furthermore, the front edge of the paper is caught by something in the fixing unit 6 and the remaining portion of the paper sent into the fixing unit 6 can be fold up into concertinas. In this case, since whole paper stays in the fixing unit 6, the jammed paper 46 cannot be removed simply by opening the access member 44.

In these cases, it will be necessary for calling for assistance of a serviceman. But the users have to wait for several hours before the serviceman comes to his or her office. To solve the user's inconvenience, some printer is constructed such that the user is allowed to take out the fixing unit 6 itself from the printer body 1 and to open a protection cover of the fixing unit 6 to remove the jammed paper from the fixing unit 6.

FIG. 4A to FIG. 4D are views for explaining a series of operations of taking out the fixing unit 6 from the printer body 1 and removing the jammed paper 46 from the fixing unit 6. In FIG. 4A to FIG. 4D, like component parts as those in FIG. 1 to FIG. 3A and FIG. 3B are designated by like reference numerals.

Figure 4A:
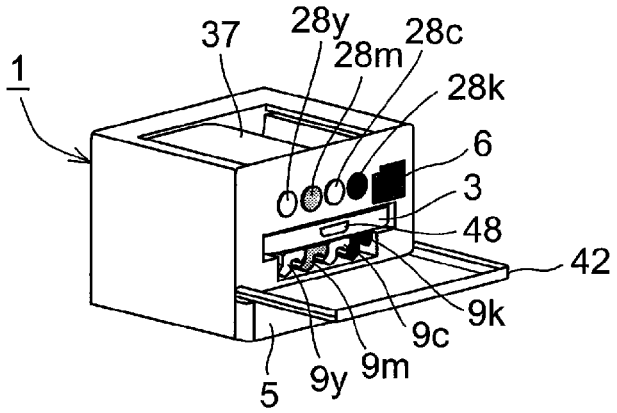
FIG. 4A to FIG. 4D are views for explaining a series of operations of taking out a fixing unit from the printer body and removing a jammed paper from the fixing unit.

FIG. 4A is a view showing the printer body 1 with the front door 42 open. As shown in FIG. 4A, the front door 42 is held substantially in the horizontal direction. On the upper side of the transfer belt unit 3, four replaceable toner cartridges 28*k*, 28*c*, 28*m*, and 28*y* are disposed. Further, the fixing unit 6 is disposed on the right side of the cartridge 28*k*.

On the lower side of the transfer belt unit 3, four developing devices 9*k*, 9*c*, 9*m*, and 9*y* are disposed, which are detachable for maintenance. A hold 48 is fixed on a front frame of the transfer belt unit 3. Further, a hold (not shown) is also provided on the fixing unit 6.

Figure 4B:
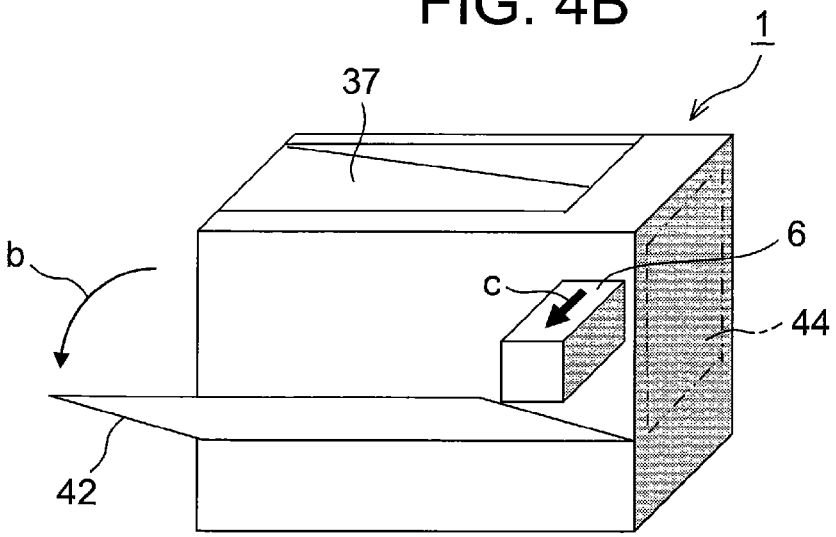

FIG. 4B is a view showing the printer body 1 with the front door 42 opened in the direction indicated by an arrow "b". The fixing unit 6 is pulled out from the printer body 1 along guide/support rails (not shown) in the direction indicated by an arrow "c".

Figure 4C:
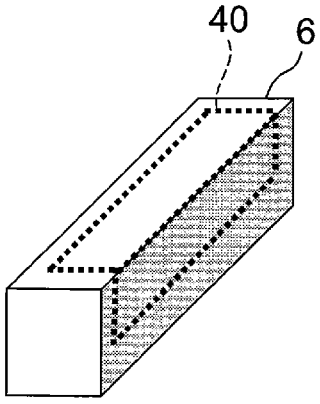
Figure 4D:
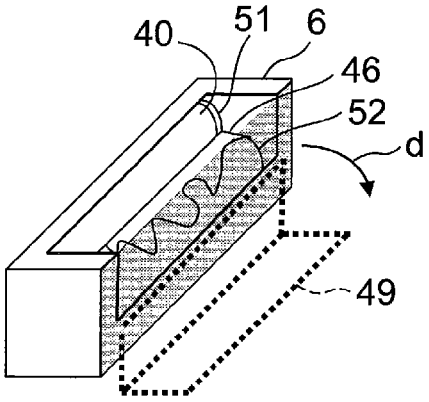

FIG. 4C is a view of the fixing unit 6 taken out from the printer body 1. The housing of the fixing unit 6 is covered with a protection cover 40. The protection cover is a member, which can be opened and closed about a hinge (not shown) in the direction indicated by an arrow "d", as shown in FIG. 4D. When the protection cover 40 is opened, components in the fixing unit 6 are exposed.

FIG. 4D is a view showing the internal components of the fixing unit 6. The internal components consist of a heat fixing roller 51 and a resiliently pressing roller (pressure roller) 52. The heat fixing roller 51 is driven by a heat transfer belt 49. The pressure roller 52 is resiliently pressed against the heat fixing roller 51 through the heat transfer belt 49.

As shown in FIG. 4D, the jammed paper 46 can be seen, which is eaten by the fixing unit 6 consisting of the rollers 51, 52 and the heat transfer belt 49. As will be understood, the user will be able to easily remove the jammed paper 46 from the fixing unit 6, when the internal components of the fixing unit 6 are exposed as shown in FIG. 4D.

In the meantime, if the user tries to take out the fixing unit 6 from the printer body 1 immediately after the jammed paper has arisen, it will be in danger of getting burned, because the internal component (heat fixing roller 51) is heated to high temperatures as high as 110 to 180 degrees Centigrade in the fixing unit 6.

The printer 1 according to the present embodiment 1 of the invention is provided with a special device, which allows the user to takeout the fixing unit 6 from the printer body 1 only after the heat fixing roller 51 has cooled down to temperatures, at which the user will not get burned. Hereinafter, the special device will be described.

Figure 5A:
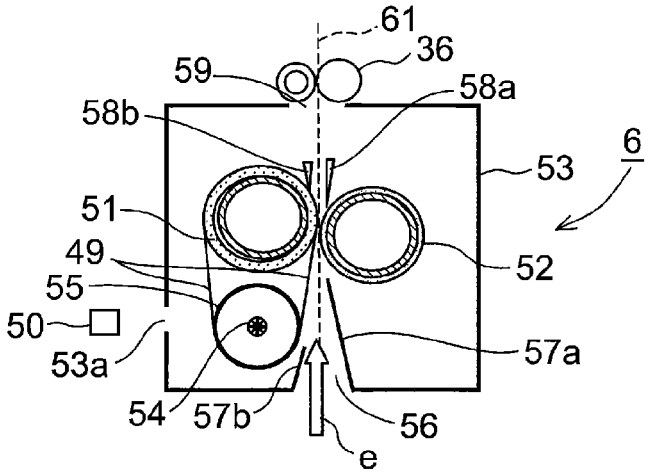
FIG. 5A is a schematic cross-sectional view showing the fixing unit of the printer in a printing operation.
Figure 5B:
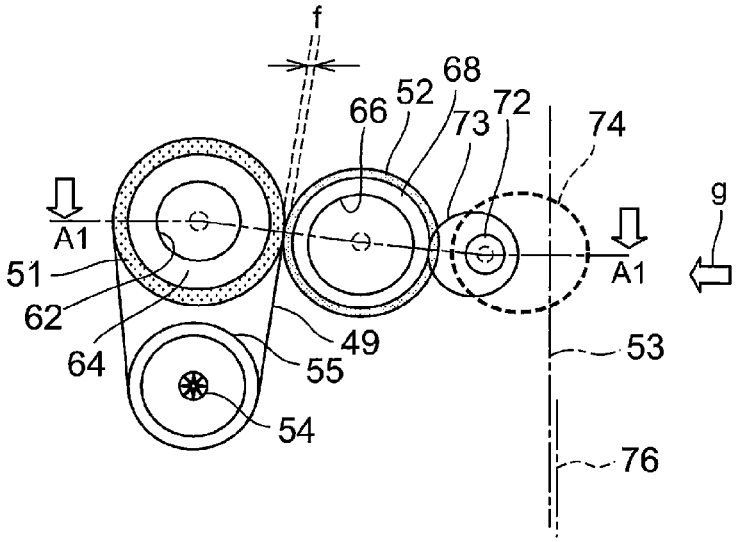
FIG. 5B is an enlarged schematic view showing the main portion of the fixing unit.
Figure 5C:
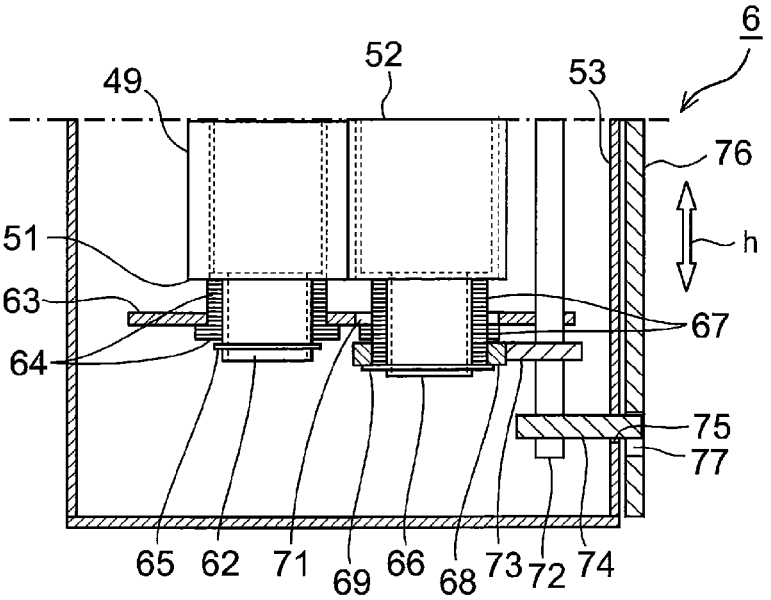
FIG. 5C is a detailed cross-sectional view of the fixing unit taken along the line A1-A1 of FIG. 5B.

FIG. 5A is a schematic cross-sectional view showing the fixing unit 6 of the printer 1 in the printing operation. FIG. 5B is an enlarged schematic view showing the main portion of the fixing unit 6. FIG. 5C is a detailed cross-sectional view of the fixing unit 6 taken on line A1-A1 of FIG. 5B.

As shown in FIG. 5A and FIG. 5B, the fixing unit 6 is provided with the heat fixing roller 51 and the pressure roller 52 in a heat-resisting housing 53. The heat transfer belt 49 is extended between the heat fixing roller 51 and a heat generating roller 55. The heat generating roller 55 has a built-in heat-generating source 54 such as a halogen lamp. The housing 53 is provided with a cutout or window 53*a* at a position facing the heat-generating source 54, and the cutout 53*a* is used for a temperature sensor 50 to measure a temperature of the heat-generating source 54. The temperature sensor 50 is fixed to a position of the frame of the printer body 1, the position of which faces the cutout 53*a* of the housing 53.

As shown in FIG. 5A, the paper 46 (shown in FIG. 3B and FIG. 4D) is guided to an inlet 56 of the fixing unit 6 from below upwards as indicated by an arrow "e", and further guided between two guide plates 57 (57*a*, 57*b*), which are provided at both sides of the inlet 56, finally to the fixing portion to be sandwiched between the heat fixing roller 51 and the pressure roller 52.

The heat transfer belt 49 receives heat from the heat generating roller 55 heated by the heat-generating source 54, and applies a radiational heating to the paper in the course along from the inlet 56 to the fixing portion to heat the same previously. In the fixing portion, the heat fixing roller 51 and the heat transfer belt 49 work together to apply heat directly onto the paper to fix the toner image on the paper with aid of the pressure roller 52.

The paper with the toner image fixed thereon passes through the fixing portion and then is prevented from wrapping around the heat transfer belt 49 or the pressure roller 52 by separators 58 (58*a*, 58*b*) and finally guided to an outlet 59. Further, as shown in FIG. 5A, the paper is discharged along the conveyance path 61 indicated by a broken line by the discharging paired-rollers 36 and guided to the paper ejecting tray 37 shown in FIG. 1.

The heat transfer belt 49 is driven by the heat fixing roller 51, and the heat generating roller 55 rotates in accordance with a turning movement of the heat transfer belt 49. Meanwhile the pressure roller 52 rotates in accordance with a turning movement of the heat fixing roller 51 and the heat transfer belt 49.

As shown in FIG. 5C, the heat fixing roller 51 is supported on an internal frame 63 of the fixing unit 6 by means of a sleeve bearing 64. More specifically, one end of a cylindrical shaft 62 of the heat fixing roller 51 is received by the sleeve bearing 64 fixed on the internal frame 63 of the fixing unit 6 and the axial movement of the shaft 62 is prevented by an end washer 65. The other end (not shown) of the shaft 62 of the heat fixing roller 51 is engaged with a driving system (not shown) of the printer 1.

As shown in FIG. 5C, the pressure roller 52 is also supported on the internal frame 63 of the fixing unit 6. More particularly, both ends (one end is not seen in FIG. 5C) of a cylindrical shaft 66 of the pressure roller 52, both ends having the same structure, are received respectively by two bearings 67, 67 fixed on the internal frame 63 of the fixing unit 6. A toric cam-follower 68 is pressed-fit on the outer race of the bearing 67 and the axial movement of the cam-follower 68 is prevented by an end washer 69.

A bearing holding member 71 of the internal frame 63 for holding the bearing 67 is formed with a play for allowing the pressure roller 52 to be pressed against or released from the heat fixing roller 51. The pressure roller 52 is always urged by bias means (not shown) to leave from the heat fixing roller 51. A cam 73, which rotates with a cam shaft 72 is in contact with the cam follower 68.

When the printer 1 is in the printing operation, the cam 73 rotates to a position where the cam 73 presses the cam follower 68, as shown in FIG. 5B and FIG. 5C, whereby the pressure roller 52 is resiliently pressed against the heat fixing roller 51 with the heat transfer belt 49 held between them, as shown in FIG. 5A, FIG. 5B, and FIG. 5C.

The outer surface of the pressure roller 52 is made of a hard material member such as metals. Meanwhile, since the heat fixing roller 51 is made of foamed rubber adhered to a metal shaft, when pressed against the pressure roller 52, the heat fixing roller 51 is slightly deformed.

In other words, as shown in FIG. 5B, the pressure roller 52 slightly digs into the heat fixing roller 51 by a depth "f", whereby the paper is tightly held between the pressure roller 52 and the heat fixing roller 51 and the toner image or printing image is firmly fixed on the paper.

The lower end portion of the camshaft 72 (as viewed in FIG. 5C) is eccentrically fixed to a stopper member 74. The stopper member 74 rotates eccentrically in the same manner as the cam 73.

When the printer 1 is in the printing operation and the cam shaft 72 eccentrically rotates to a position where the cam 73 presses the pressure roller 52 in the direction indicated by an arrow "g" towards the heat fixing roller 51 through the cam follower 68, as shown in FIG. 5B, the stopper member 74 eccentrically rotates in accordance with the rotation of the cam shaft 72.

The portion (most distant portion) of the stopper member 74 which is most distant from the cam shaft 72 penetrates an opening 75 provided in a side wall of the housing 53 and comes into an opening 77 of a guide frame 76 of the printer body 1, as shown in FIG. 5C. Then, the fixing unit 6 cannot be removed from the printer body 1 in the front-back direction, that is, in the horizontal direction as indicated by an arrow "h" in FIG. 5C.

As described above, when the cam 73 stays at the position where the cam follower 68 presses the pressure roller 52 against the heat fixing roller 51, the stopper member 74 comes into the opening 77 of the guide frame 76 of the printer body 1, preventing the fixing unit 6 from being removed from the printer body 1, as clearly shown in FIG. 5C.

In the present embodiment of the invention, when the temperature of the heat fixing roller 51 of the fixing unit 6 decreases, for example, to 100 degrees Centigrade or less, then the controlling unit (not shown) determines that the printer 1 is not in the printing operation, and makes the cam shaft 72 rotate by 180 degrees from the position shown in FIG. 5C. It is apparent that a threshold value, based on which the controlling unit determines whether or not the printer 1 is in the printing operation is not limited to 100 degrees Centigrade, and the threshold value can be set to 100 degrees Centigrade or less, for example, the threshold value can be set to 70 degrees Centigrade. Therefore, it can be described in the present embodiment, that the temperature of the fixing unit 6 is 100 degrees Centigrade or less, based on which temperature the controlling unit determines that the printer 1 is not in the printing operation and makes the cam shaft 72 rotate 180 degrees from the position shown in FIG. 5C.

Figure 6A:
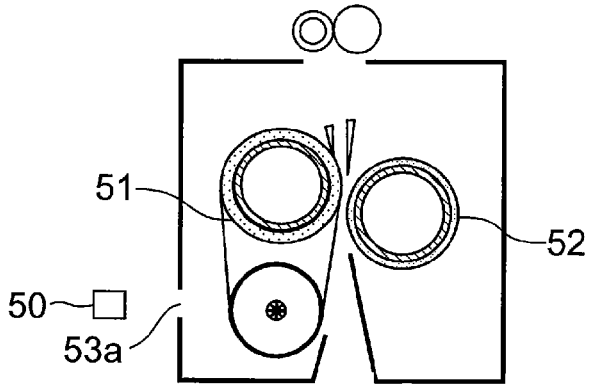
FIG. 6A is a view showing the cam shaft of FIG. 5A, which rotates 180 degrees from a position shown in FIG. 5C.
Figure 6B:
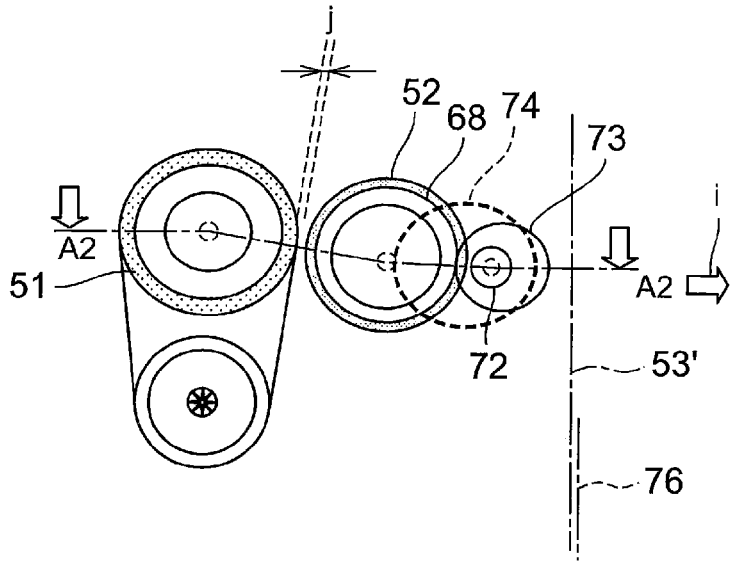
FIG. 6B is a view showing the cam shaft of FIG. 5B, which rotates 180 degrees from the position shown in FIG. 5C.
Figure 6C:
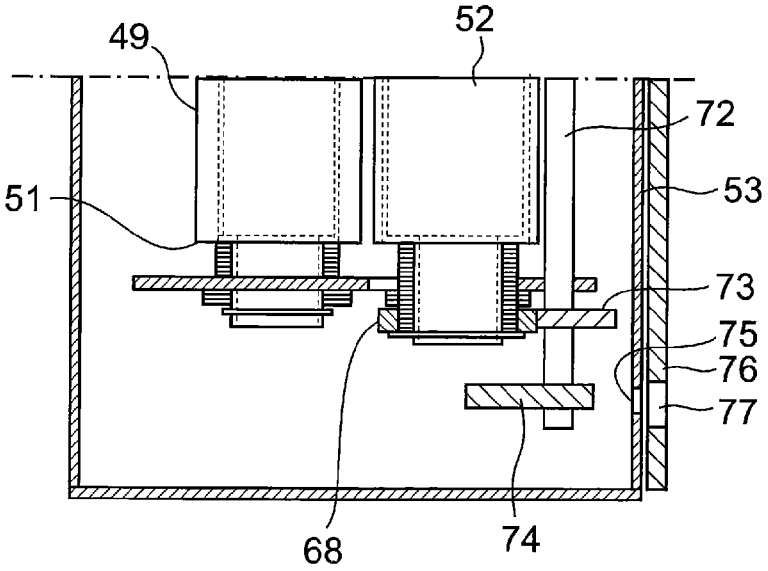
FIG. 6C is a view showing the cam shaft of FIG. 5C, which rotates 180 degrees from the position shown in FIG. 5C.

FIG. 6A is a view showing a relative position between the heat fixing roller 51 and the pressure roller 52 after the cam shaft 72 of FIG. 5A rotates 180 degrees from the position shown in FIG. 5C. FIG. 6B is a view showing the cam shaft 72 of FIG. 5B, which rotates 180 degrees from the position shown in FIG. 5B. FIG. 6C is a view showing the cam shaft 72 of FIG. 5C, which rotates 180 degrees from the position shown in FIG. 5C. FIG. 6C is a detailed cross-sectional view of the fixing unit 6 taken on line A2-A2 of FIG. 6B. In FIG. 6A, FIG. 6B, and FIG. 6C, like component parts as those in FIG. 5A, FIG. 5B, and FIG. 5C are designated by like reference numerals.

As described above, when the temperature of the heat fixing roller 51 of the fixing unit 6 decreases to 100 degrees Centigrade or less and it is determined that the printer 1 is not in the printing operation and the cam shaft 72 rotates 180 degrees from the position shown in FIG. 5C, then the portion (closest portion) of the cam 73 closest to the cam shaft 72 will be in contact with the cam follower 68, as shown in FIG. 6B and FIG. 6C.

The pressure roller 52 is pressed by the bias means (not shown) in the direction (indicated by an arrow "i" in FIG. 6B) opposite to the heat fixing roller 51 by a difference between the most distant portion of the cam 73 and the closest portion of the cam 73, wherein the most distant portion of the cam 73 is the portion of the cam 73 which is the most distant from the cam shaft 72. Then, a distance "j" is left between the pressure roller 52 and the heat fixing roller 51 as shown in FIG. 6B, and this distance "j" prevents the heat fixing roller 51 from deforming by an amount "f" indicated in FIG. 5B.

Meanwhile, the most distant portion of the stopper member 74, which penetrates the opening 75 provided in the housing 53 and stays in the opening 77 of the guide frame 76 of the printer body 1, gets out of the openings 77 and 75, and stays within the fixing unit 6.

While the most distant portion of the stopper member 74 stays within the fixing unit 6, the user is allowed to take out the fixing unit 6 from the printer body 1 to perform the jammed-paper removing operation (FIG. 4A to FIG. 4D).

The pressure roller 52 is brought from a pressing state to a releasing state at a time when the temperature sensor 50 has detected that the temperature of the heat fixing roller 51 decreases to a predetermined temperature or less (in the present embodiment, 100 degrees Centigrade or less), wherein, under the pressing state the pressure roller 52 is pressed against the heat fixing roller 51 and under the releasing state the pressure roller 52 is released from the heat fixing roller 51.

An experiment taught that if the temperature of the heat fixing roller 51 decreases to 100 degrees Centigrade or less, the user can safely remove the fixing unit 6 from the printer body 1 in no danger of getting burned.

A mechanism will be described, which automatically releases the resilient pressure to be applied onto the Nip portion of fixing paired-rollers, when the fixing unit 6 is unlocked from its operating position. In general, the fixing unit 6 is provided with a cam mechanism for automatically pressing and/or releasing the pressure roller 52 against or from the heat fixing roller 51.

A mechanism, which is composed of the stopper member fixed to the cam shaft, the opening provided in the housing of the fixing unit, and the opening provided in the guide frame of the printer body, serves as a mechanical locking mechanism for performing a locking and/or lock-releasing operation depending on the temperature of the fixing unit, wherein the locking operation does not allow the user to remove the fixing unit from the printer body and on the contrary the lock-releasing operation allows the user to remove the fixing unit from the printer body.

Figure 7A:
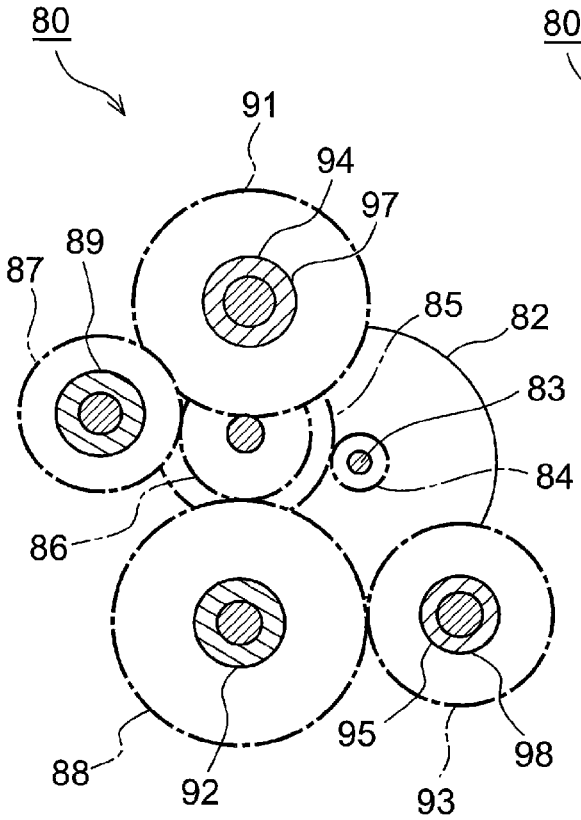
FIG. 7A is a front view showing the fixing unit and a driving system for driving its mechanical locking mechanism.
Figure 7B:
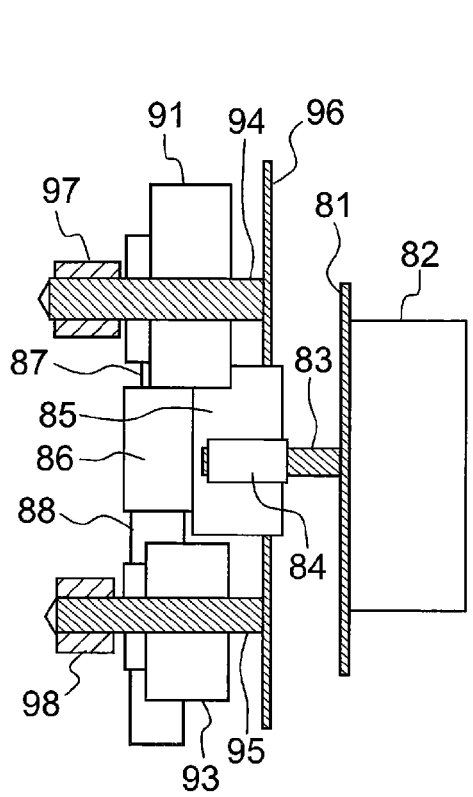
FIG. 7B is a side view showing the fixing unit and the driving system for driving its mechanical locking mechanism.

FIG. 7A is a front view showing the fixing unit 6 and a driving system for driving its mechanical locking mechanism. FIG. 7B is a side view showing the fixing unit 6 and the driving system for driving its mechanical locking mechanism. The driving system 80 for driving the fixing unit 6 is mounted on the frame 81 of the printer body 1, and has an electric motor 82, which rotates in both normal and inverse directions.

The rotary shaft 83 of the motor 82 has a pinion 84 on its end. The pinion 84 meshes with a large-diameter gear 85 of a double-diameter reduction gear. A small-diameter gear 86 of the double-diameter reduction gear meshes with a first idle gear 87 and a second idle gear 88.

The first idle gear 87 is provided with a one way clutch, and transmits only the normal rotational motion of the motor 82 to a first coupling gear 91. Meanwhile, the second idle gear 88 is provided with a one way clutch 92, and transmits only the inverse rotational motion of the motor 82 to a second coupling gear 93.

A rotary shaft 94 of the first coupling gear 91 and a rotary shaft 95 of the second coupling gear 93 are supported on the frame 96 of the printer body 1, and are provided with couplings 97, 98 on their ends, respectively.

Figure 8A:
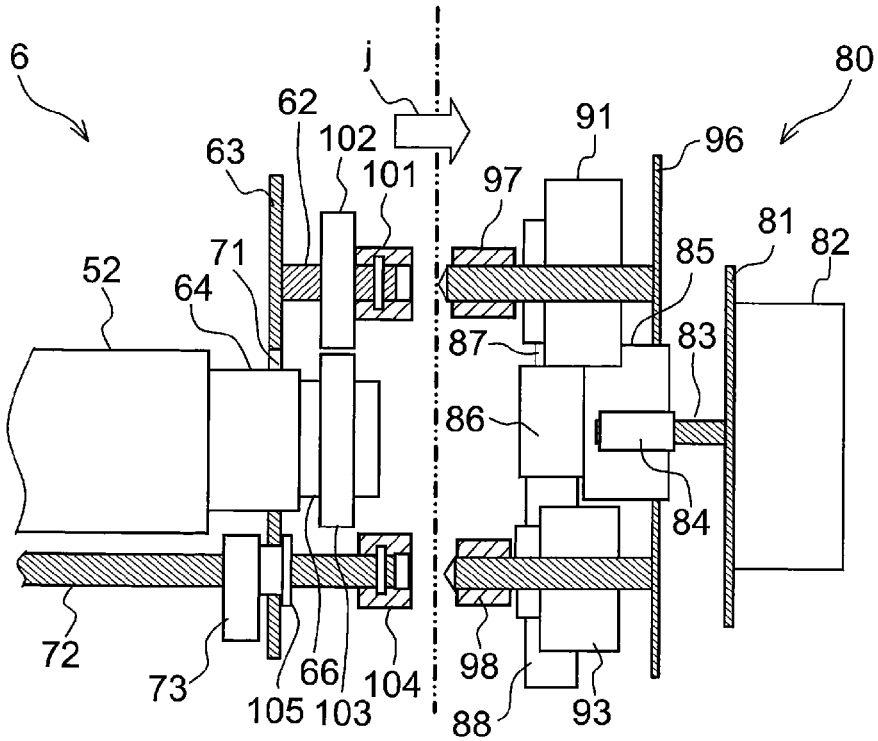
FIG. 8A is a view showing the fixing unit, which is in a state to be engaged with a driving system of the fixing unit.
Figure 8B:
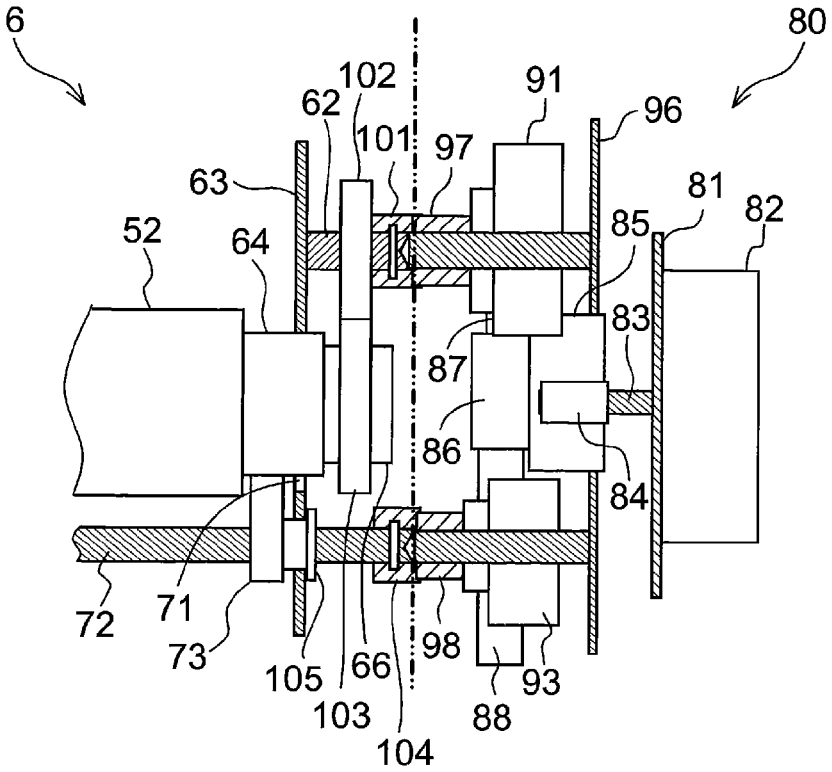
FIG. 8B is a view showing the fixing unit, which is completely engaged with the driving system of the fixing unit.

FIG. 8A is a view showing the fixing unit 6, which is installed into the printed body 1 along the guide frame 76 of the printer body 1 shown in FIG. 5C and FIG. 6C, and is in a state to be engaged with the driving system 80 for the fixing unit 6. FIG. 8B is a view showing the fixing unit 6, which is completely engaged with the driving system 80 for the fixing unit 6 (fixing-unit driving system).

The guide frame 76 of the printer body 1 and the housing 53 of the fixing unit 6 are not shown in FIG. 8A and FIG. 8B. The part of the fixing unit 6, which is not shown in FIG. 5C and FIG. 6C, is shown in FIG. 8A and FIG. 8B. The heat transfer belt 49 is omitted from the views of FIG. 8A and FIG. 8B.

Concerning the heat fixing roller 51, only its shaft 62 is indicated with its roller and bearing omitted in FIG. 8A and FIG. 8B. In FIG. 8A and FIG. 8B, like component parts as those in FIG. 5A, FIG. 5B, FIG. 5C, and FIG. 6A, FIG. 6B, FIG. 6C, and FIG. 7A, FIG. 7B are designated by like reference numerals.

In FIG. 5A, FIG. 5B, FIG. 5C, and FIG. 6A, FIG. 6B, FIG. 6C, the cam 73 is in contact with the cam follower 68, but in FIG. 8A and FIG. 8B (the same as in FIG. 9A and FIG. 9B), the sleeve bearing 64 is used in place of the cam follower 68 for the sake of ease in drawing.

When the fixing unit 6 is installed deep into the printer body 1 (installing unit) in the direction indicated by an arrow "j" shown in FIG. 8A to engage with the fixing-unit driving system 80 as shown in FIG. 8B, the coupling 97 of the first coupling gear 91 of the fixing-unit driving system 80 engages with a coupling 101 of the cylindrical shaft 62 of the heat fixing roller 51 of the fixing unit 6.

A driving gear 101 is fixed between the portion of the internal frame 63 supporting the cylindrical shaft 62 and the coupling 101. A driven gear 103 is fixed on the cylindrical shaft 66 of the pressure roller 52.

A coupling 98 of the second coupling gear 93 of the fixing-unit driving system 80 engages with a coupling 104 of the cam shaft 72 of the fixing unit 6. The both ends of the cam shaft 72 (Refer to FIG. 9A and FIG. 9B) are supported on the internal frame 63 by means of bearings 105, 105.

Figure 9A:
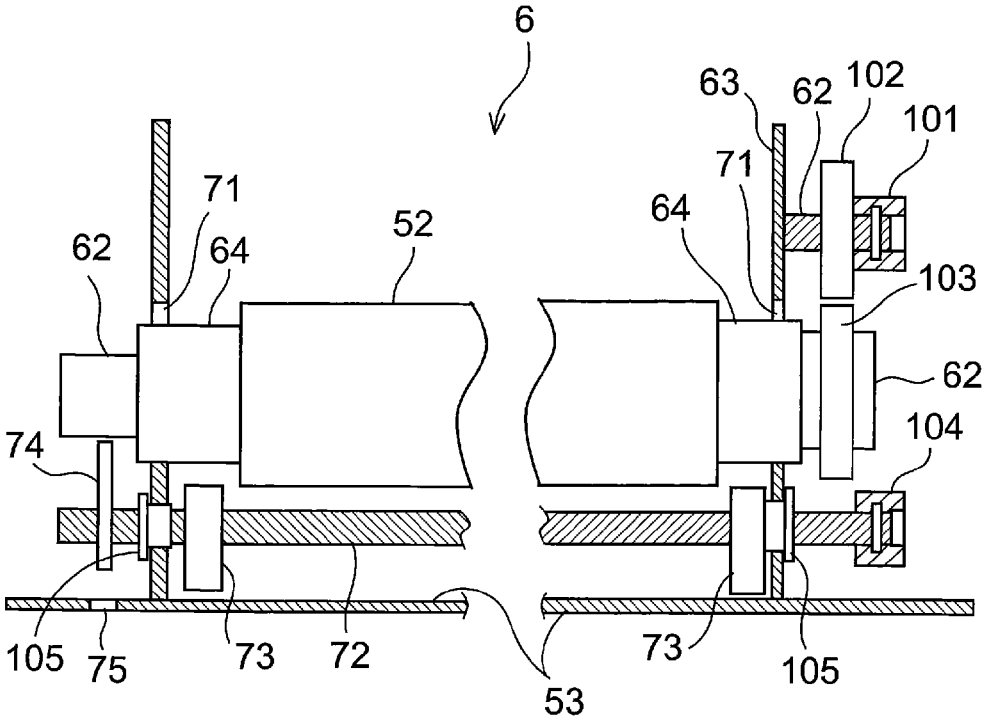
FIG. 9A is a view showing the fixing unit, which is installed to the installing portion of the printer body.
Figure 9B:
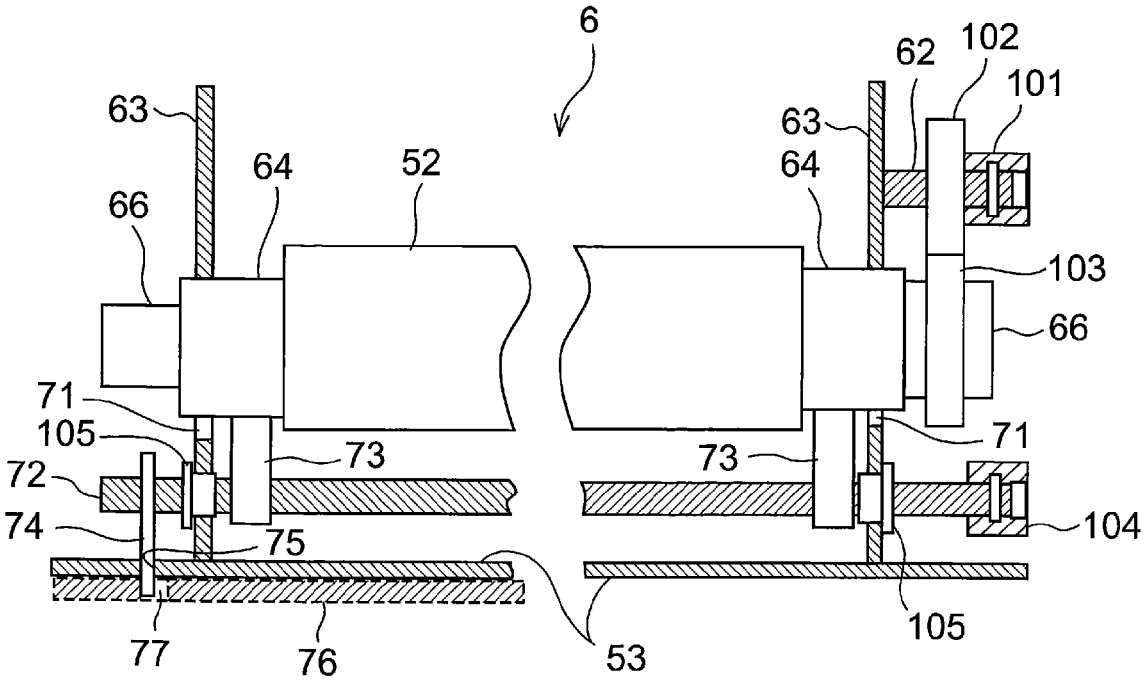
FIG. 9B is a view showing the fixing unit, which is installed and locked to the installing portion of the printer body.

FIG. 9A is a view showing the fixing unit 6, which is installed to the installing unit of the printer body 1 (the same as in FIG. 6C). FIG. 9B is a view showing the fixing unit 6, which is installed and locked to the installing portion of the printer body 1 (the same as in FIG. 5C). In FIG. 9A and FIG. 9B, like component parts as those in FIG. 5A, FIG. 5B, FIG. 5C, and FIG. 6A, FIG. 6B, FIG. 6C, and FIG. 8A, FIG. 8B are designated by like reference numerals.

Figure 10:
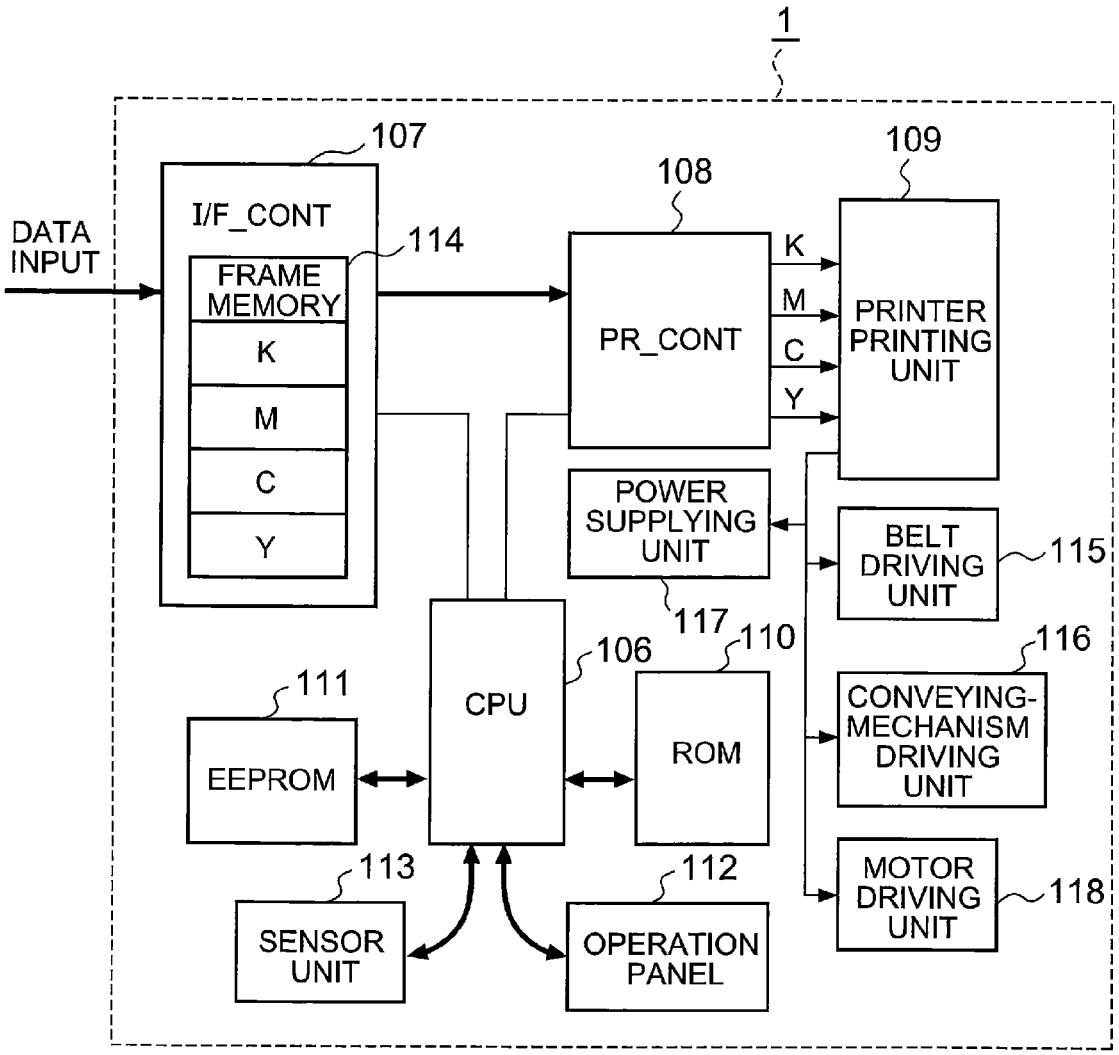
FIG. 10 is a block diagram of an electric unit of the printer, including a controlling unit.

FIG. 10 is a block diagram of the electric unit 30 of the printer 1 including the controlling unit. As shown in FIG. 10, the electric unit 30 includes CPU (Central Processing Unit) 106.

CPU 106 is connected with an interface controller (I/F-CONT) 107 and a printer controller (PR-CONT) via a data bus. The PR-CONT is further connected with a printer printing-unit 109.

Further, CPU 106 is connected with ROM (Read Only Memory) 110, EEPROM (Electrically Erasable and Programmable ROM) 111, an operation panel 112 of an operation unit, and a sensor unit 113, to which outputs are sent from sensors disposed in various units.

A system program is stored in ROM 110, and CPU 106 controls operations of the various units in accordance with the system program stored in ROM 110. Each unit performs its process under control of CPU 106.

I/F-CONT 107 receives printing data sent from host apparatuses, for example, such as personal computers, and converts the received printing data into bit map data and further expands the bit map data in a frame memory 114.

Storing areas for the respective colors of Black (K), Magenta (M), Cyan (C), and Yellow (Y) are prepared in the frame memory 114. These pieces of image data of the respective colors are expanded on the corresponding storing areas of the frame memory 114.

The image data expanded on the frame memory 114 is supplied to PR-CONT 108, and further supplied to the printer printing-unit 109.

The printer printing-unit 109 functions as an engine unit, and performs a drive controlling operation of a belt driving unit 115. The belt driving unit 115 drives the driving roller 21 of the transfer belt unit 3 under control of PR-CONT 108 to drive the transfer belt 8.

Further, the printer printing-unit 109 performs the drive controlling operation of a conveying-mechanism driving unit 116. The conveying mechanism driving unit 116 drives a conveying mechanism consisting of driven units including the paper take-up rollers 31, paper-sending rollers 32, paper-handling rollers 33, stand-by conveying paired-rollers 34, paper ejecting paired-rollers 38, photoreceptor drum 10, and the heat fixing roller 51 of the fixing unit 6.

The printer printing-unit 109 controls an output voltage of a power supplying unit 117. The power supplying unit 117 applies electric power to an image forming system including the charge rollers 12, optical writing heads 13, primary transfer rollers 20, secondary transfer rollers 35, and also to the built-in heat-generating source 54 of the heat generating roller 55 in the fixing unit 6.

The printer printing-unit 109 controls a motor driving unit 118. The motor driving unit 118 watches an output sent from the temperature sensor 50 through the senor unit 113 and CPU 106 to judge whether or not the temperature of the fixing unit 6 reaches a predetermined threshold value (for example, 100 degrees Centigrade), and makes the electric motor 82 rotate in the normal or inverse direction depending on whether or not the temperature of the fixing unit 6 has reached the threshold value.

Plural pieces of image data of four colors, Black (K), Magenta (M), Cyan (C), and Yellow (Y), output from PR-CONT 108 are supplied to the printer printing-unit 109, and further supplied to the corresponding optical writing heads 13 (shown in FIG. 1), respectively.

Each of the optical writing heads 13 forms an optical latent image on the outer periphery of the photoreceptor drum 10 based on the image data sent from the printer printing-unit 109, wherein the photoreceptor drum 10 is previously initialized by the charge rollers 12. The developing device 9 develops the electrostatic latent image on the photoreceptor drum 10 to a toner image.

The toner images developed on the photoreceptor drum 10 are successively transferred onto transfer belt 8 by the primary transfer rollers 20 to be superimposed on the former image in order of the toner images of the colors, Yellow (Y), Magenta (M), Cyan (C), and Black (K) as seen from the upper stream.

The transfer belt 8 conveys the superimposed toner images to the secondary transferring unit 23. The secondary transferring unit 23 transfers the superimposed toner images onto the paper (secondary transfer). The paper with the toner image transferred is sent to the fixing unit 6. The fixing unit 6 applies heat and pressure to the toner image to fix the same on the paper.

Even if the user should try to take out the fixing unit 6 from the printer body 1 due to the jammed paper arisen in the course of the image forming process, the fixing unit 6 is kept in the locked state and cannot be taken out from the printer body 1 until the temperature of the fixing unit 6 has decreased to 100 degrees Centigrade or less.

Figure 11:
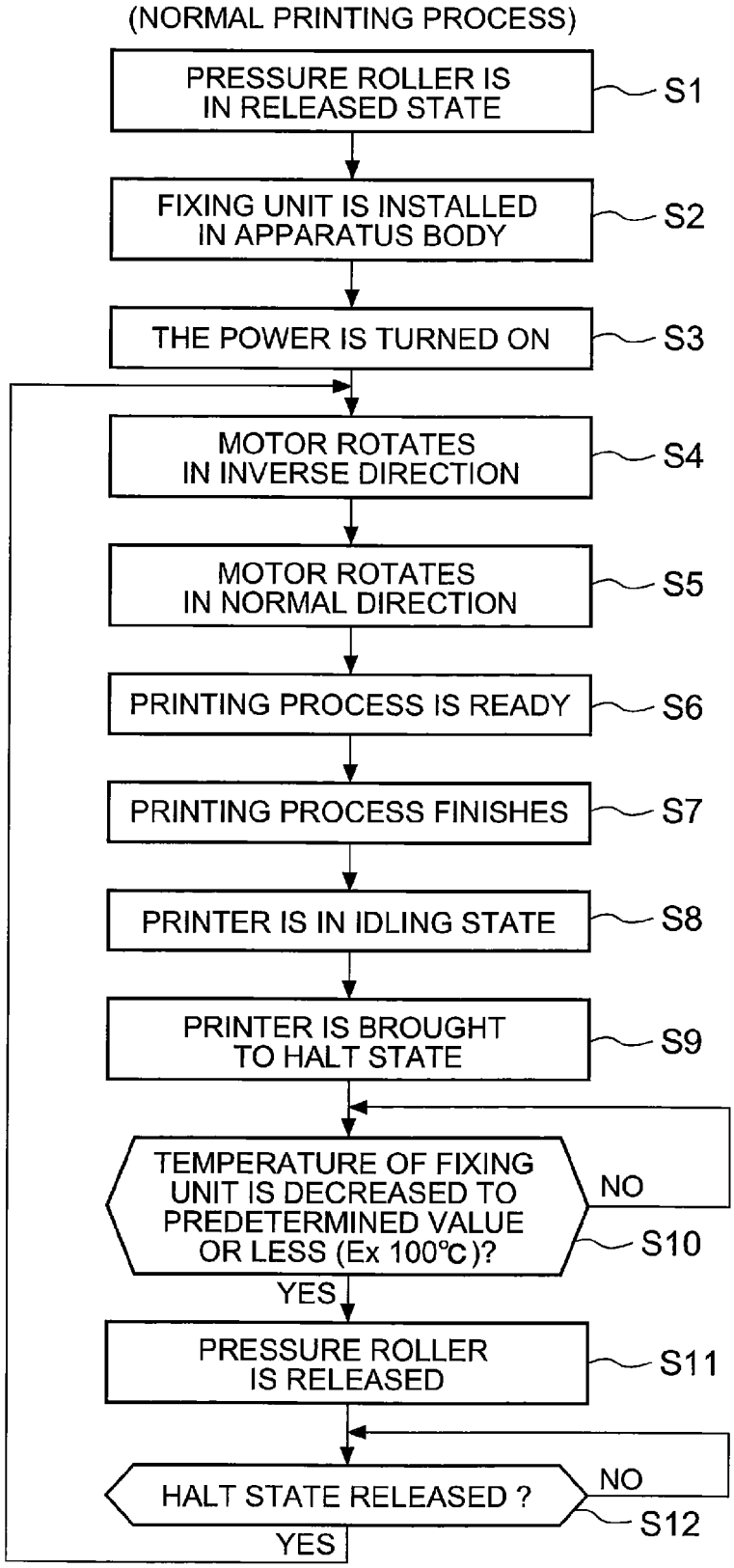
FIG. 11 is a flow chart of a normal printing process performed by the printer according to the present embodiment of the invention.
Figure 12:
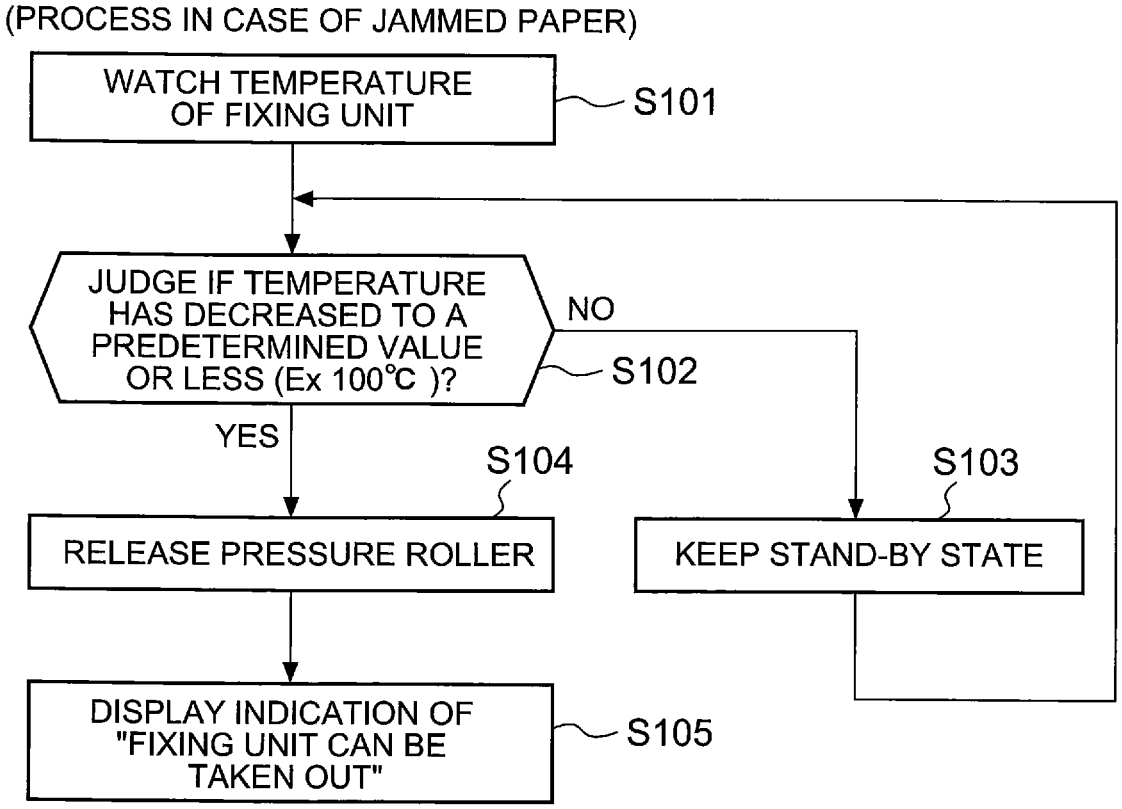
FIG. 12 is a flow chart of a process performed in case of a jammed paper.

FIG. 11 is a flow chart of the normal printing process performed by the printer 1 according to the present embodiment of the invention. FIG. 12 is a flow chart of a process performed at the occurrence of the jammed paper. These flow charts are for explaining processes performed by the controlling unit to control the operation of the mechanical locking mechanism coordinating with the pressure roller 52 of the fixing unit 6, depending on the temperature of the fixing unit. The processes will be described with reference to FIG. 7A, FIG. 7B to FIG. 9A, FIG. 9B.

At step S1 in the flow chart of FIG. 11, in general, the pressure roller 52 is released from the transfer belt 62 and the heat fixing roller 51 at the initial time, and stays at a position shown in FIG. 8A or FIG. 9A. That is, the fixing unit 6 can be taken out from the installing unit of the printer body 1 (step S1).

The controlling unit confirms based on a signal sent from a position detecting sensor (not shown) that the fixing unit 6 has been correctly installed on the installing unit (step S2), and turns on the power to the fixing unit 6 (step S3). In these processes, the motor driving unit 118 is brought into a controlling condition for driving the motor 82.

Then, the motor rotates in the inverse direction to bring the pressure roller 52 to the position, where the pressure 52 is resiliently pressed to the heat fixing roller 51 (step S4). In this process, the first idle gear 87 transmits only the normal rotational motion of the motor 82 to the first coupling gear 91, as described with reference to FIG. 7A and FIG. 7B. In other words, when the motor 82 rotates in the inverse direction, the first coupling gear 91 does not move. Therefore, no rotational movement is transmitted to the shaft 62 and the heat fixing roller 51 stays still in FIG. 8B.

Meanwhile, since the second idle gear 88 transmits only the inverse rotational motion of the motor 82 to the second coupling gear 93, the cam shaft 72 is made to rotate 180 degrees by the couplings 98 and 104 from the state shown in FIG. 9A to the state shown in FIG. 9B. The periphery of the most distant portion of the cam 73 is in contact with the sleeve bearing 64, whereby the pressure roller 52 is brought to the position by the sleeve bearing 64, where the shaft 66, that is, the pressure roller 52 is resiliently pressed against the heat fixing roller 51. To rotate the cam shaft 72 by 180 degrees, a rotational ratio of each of the pinion 84 of the motor 82, the large-diameter gear 85, the small-diameter gear 86, the second idle gear 88, the second coupling gear 93, and the couplings 98 and 104 is previously calculated, and the number of rotations of the motor 82 is determined, and then the motor 82 is made to rotate by the determined number of rotations. In this case, for instance, it is also possible to make the camshaft 72 rotate just by 180 degrees by making the cam shaft 72 rotate little by little, while a sensor is detecting a rotational position by reading a marker on either of the cam shaft 72, the cam 72 and the stopper member 74.

Further, the controlling unit makes the motor 82 rotate in the normal direction, and supplies the power to the heat-generating source 54 of the heat generating roller 55, and watches a value shown by the temperature sensor 50 until the temperature of the heat-generating source 54 increases to an appropriate value (step S5).

In this process, since the first idle gear 87 transmits only the normal rotational motion of the motor 82 to the first coupling gear 91 as described above, the shaft 62, that is, the heat fixing roller 51 is driven by means of couplings 97 and 101 in FIG. 8B.

Meanwhile, the second idle gear 88 transmits only the inverse rotational motion of the motor 82 to the second coupling gear 93. In other words, when the motor 82 rotates in the normal direction, the second coupling gear 93 does not move. Therefore, no rotational movement is transmitted to the cam shaft 72 and the pressure roller 52 keeps the pressing state to the heat fixing roller 51 and is driven in accordance with the rotational movement of the heat fixing roller 51 through the driving gear 102 and the driven gear 103.

Thereafter, when the motor 82 keeps the rotation in the normal direction and the temperature of the fixing unit 6 has reached a predetermined value, the printer 1 becomes ready to start a process of printing on the paper (step S6). The printer 1 performs and finishes the printing process (step S7).

During the printing process, the controlling unit keeps watching the output value of the temperature sensor 50, and repeatedly performs turn-on and turn-off operations of the power to the heat-generating source 54, thereby increasing and/or decreasing the temperature with an appropriate threshold value at its center, and controlling the temperature of the fixing unit 6 to keep the same within the allowable range of the appropriate temperature.

When the printing process has finished, the controlling unit sets the printer 1 to the idle state (step S8), and further brings to the halt state (step S9). In the halt state, the controlling unit keeps watching the output of the temperature sensor 50 until the temperature of the fixing unit 6 decreases to a predetermined temperature (for example, 100 degrees Centigrade) or less (step S10).

When it is confirmed that the temperature of the fixing unit 6 has decreased to the predetermined temperature or less, the controlling unit makes the motor 82 rotate in the inverse direction to release the pressure roller 52 from the heat fixing roller 51 (step S11). As described above, when the motor 82 rotates in the inverse direction, the heat fixing roller 51 does not rotate. As a result, the pressure roller 52 does not move, too. Only the cam shaft 72 rotates 180 degrees from the state shown in FIG. 9B, and moves to the state shown in FIG. 9A.

The periphery of the closest portion of the cam 73 faces the sleeve bearing 64. And the sleeve bearing 64 moves to the lower end of the bearing holding member 71 of the internal frame 63, which member having a play, and is released from the pressing state.

The fixing unit 6 with the pressure roller 52 released from the pressing state is shown in FIG. 9A. The fixing-unit driving system 80 of the printer 1 shown in FIG. 8A and FIG. 8B is not shown in FIG. 9A and FIG. 9B.

Now, a process, which is performed when a paper is jammed, will be described with reference to the flow chart shown in FIG. 12. The controlling unit detects the temperature of the heat fixing unit 6 based on the output signal from the temperature sensor 50 (step S101). The controlling unit judges whether or not the temperature of the heat fixing unit 6 has decreased to the predetermined temperature (for example, 100 degrees Centigrade) or less (step S102).

When it is determined that the temperature of the heat fixing unit 6 has not decreased to the predetermined temperature (NO at step S102), the controlling unit keeps the standby state and makes a cooling fan (not shown) work to cool down the heat fixing unit 6 (step S103). Again, the controlling unit returns to step S102.

When it is determined that the temperature of the heat fixing unit 6 has decreased to the predetermined temperature or less (YES at step S102), the controlling unit makes the motor 82 rotate in the inverse direction to release the pressure roller 52 from the pressing state (step S104).

As described above, when the motor 82 rotates in the inverse direction, the heat fixing roller 51 does not rotate. As a result, the pressure roller does not move, too. Only the cam shaft 72 rotates 180 degrees from the state shown in FIG. 9B, and moves to the state shown in FIG. 9A.

The periphery of the closest portion of the cam 73 faces the sleeve bearing 64. And the sleeve bearing 64 moves to the lower end of the bearing holding member 71 of the internal frame 63, which member having a play, and is released from the pressing state.

In this state of the printer 1, the controlling unit displays an indication of "Fixing unit can be taken out" on an liquid crystal displaying device in the operation panel 112 on the top of the printer body 1, informing the user that the user can safely take out the fixing unit 6 from the printer body 1.

The mechanical locking mechanism and the controlling system according to the present embodiment can resolve inconveniences, in which the users get their hands burned by the hot heat fixing unit 6 while taking out the heat fixing unit 6 from the printer body 1 for maintenance purpose.

The cam shaft takes a time before it releases the locking of the stopper member, in other word, the heat roller needs some waiting time before its temperature decreases to the predetermined value or less (several seconds to ten and several seconds are needed depending on the state of the fixing unit).

But, needless to say, safety receives the highest priority. If this "safety first" will be understood by the users, the inventor of the present invention believes the problem of the waiting time will be accepted by the users as an allowable matter.

Having described and illustrated the principles of the present invention by reference to one preferred embodiment, it should be apparent that the preferred embodiment may be modified in arrangement and detail without departing from the principles disclosed herein and that it is intended that the invention be construed as including all such modifications and variations insofar as they come within the spirit and scope of the subject matter disclosed herein.

What is claimed is:

1. An image forming apparatus comprising:

an apparatus body having a frame;

a detachable fixing unit having fixing paired-rollers, and installed in the apparatus body;

a heating/controlling unit for heating and controlling at least one of a first roller and a second roller of the fixing paired-rollers of the detachable fixing unit;

a driving source unit for driving the at least one of the first roller and the second roller of the fixing paired-rollers heated by the heating/controlling unit;

a temperature detecting unit for detecting a temperature of the detachable fixing unit; and an adjustment mechanism for preventing the detachable fixing unit from being taken out of the apparatus body when the temperature detecting unit determines that the temperature of the detachable fixing unit exceeds a predetermined value, and for allowing the detachable fixing unit to be taken out of the apparatus body when the temperature detecting unit determines that the temperature of the detachable fixing unit does not exceed the predetermined value;

wherein the adjustment mechanism comprises:

a cam mechanism having a rotary shaft for bringing the first roller of the fixing paired-rollers of the detachable fixing unit in contact with or out of contact with the second roller;

a stopper member provided on the rotary shaft of the cam mechanism and rotating together with a rotational movement of the cam mechanism; and a stopper-member receiver formed in the frame of the apparatus body for engaging with the stopper member;

wherein the cam mechanism rotates to a first position to make the first roller of the fixing paired-rollers of the detachable fixing unit resiliently press the second roller when the temperature detecting unit determines that the temperature of the detachable fixing unit exceeds the predetermined value, and rotates to a second position to make the first roller of the fixing paired-rollers of the detachable fixing unit separate from the second roller when the temperature detecting unit determines that the temperature of the detachable fixing unit does not exceed the predetermined value; and wherein the stopper member rotates to engage with the stopper-member receiver formed in the frame of the apparatus body when the cam mechanism rotates to the first position, thereby preventing the detachable fixing unit from being taken out of the apparatus body, and rotates to disengage from the stopper-member receiver when the cam mechanism rotates to the second position, thereby allowing the detachable fixing unit to be taken out of the apparatus body.

2. The image forming apparatus according to claim 1, further comprising:

a driving force conveying mechanism for conveying a driving force from the driving source unit to the adjustment mechanism.

3. The image forming apparatus according to claim 1, wherein a direction in which the detachable fixing unit is taken out of and/or installed into the apparatus body is equivalent to an alignment direction of shafts of the fixing paired-rollers of the detachable fixing unit.

4. The image forming apparatus according to claim 3, further comprising:

an opening-and-closing door provided on the apparatus body, and wherein the direction in which the detachable fixing unit is taken out of and/or installed into the apparatus body is equivalent to a direction of an opening and closing operation of the opening-and-closing door of the apparatus body.

5. The image forming apparatus according to claim 1, further comprising:

an opening-and-closing door provided on the apparatus body, and wherein a direction in which the detachable fixing unit is taken out of and/or installed into the apparatus body is equivalent to a direction of an opening and closing operation of the opening-and-closing door of the apparatus body.

6. The image forming apparatus according to claim 1, wherein a direction in which the detachable fixing unit is taken out of and/or installed into the apparatus body is equivalent to an alignment direction of shafts of the fixing paired-rollers of the detachable fixing unit.

7. The image forming apparatus according to claim 6, further comprising:

an opening-and-closing door provided on the apparatus body, and wherein the direction in which the detachable fixing unit is taken out of and/or installed into the apparatus body is equivalent to a direction of an opening and closing operation of the opening-and-closing door of the apparatus body.

8. The image forming apparatus according to claim 1, further comprising:

an opening-and-closing door provided on the apparatus body, and wherein a direction in which the detachable fixing unit is taken out of and/or installed into the apparatus body is equivalent to a direction of an opening and closing operation of the opening-and-closing door of the apparatus body.

9. The image forming apparatus according to claim 1, wherein the predetermined value is set to 100 degrees Centigrade or less.

10. The image forming apparatus according to claim 1, further comprising:

a jammed-paper detecting mechanism for detecting a jammed paper that arises in a vicinity of a position where the detachable fixing unit is installed, and wherein the heating/controlling unit ceases heating the at least one roller of the fixing paired-rollers when the jammed paper is detected by the jammed-paper detecting mechanism.

* * * * *